US007195132B1

(12) United States Patent
Balam

(10) Patent No.: US 7,195,132 B1
(45) Date of Patent: Mar. 27, 2007

(54) INFLATABLE FLOATING COOLER

(75) Inventor: James V. Balam, Virginia Beach, VA (US)

(73) Assignee: Swimways Corporation, Virginia Beach, VA (US)

( * ) Notice: Subject to any disclaimer, the term of this patent is extended or adjusted under 35 U.S.C. 154(b) by 368 days.

(21) Appl. No.: 10/452,272

(22) Filed: Jun. 2, 2003

Related U.S. Application Data

(60) Provisional application No. 60/384,967, filed on Jun. 3, 2002.

(51) Int. Cl.
*B65D 25/00* (2006.01)
*B65D 88/78* (2006.01)

(52) U.S. Cl. ..... 220/560; 383/3

(58) Field of Classification Search ..... 220/560, 220/592.24; 441/129, 130; 383/3, 4
See application file for complete search history.

(56) References Cited

U.S. PATENT DOCUMENTS

| | | | | |
|---|---|---|---|---|
| 2,531,562 | A | 11/1950 | Eve | |
| 2,652,698 | A | 9/1953 | Schlumbohm | |
| 3,015,406 | A | 1/1962 | Nolte | |
| D215,959 | S | 11/1969 | Kelso et al. | |
| 3,799,386 | A | 3/1974 | Madalin et al. | |
| 3,935,607 | A * | 2/1976 | Cantwell et al. | 114/345 |
| D239,673 | S | 4/1976 | Ziegler | |
| 4,085,785 | A | 4/1978 | Hoot | |
| 4,190,158 | A * | 2/1980 | Ambrose | 206/522 |
| 4,534,474 | A | 8/1985 | Ng | |
| 4,638,593 | A | 1/1987 | Garcia | |
| D290,674 | S | 7/1987 | Valov | |
| 4,741,176 | A | 5/1988 | Johnson et al. | |
| 4,809,352 | A | 2/1989 | Walker | |
| D300,796 | S | 4/1989 | Waggerman | |
| 4,826,060 | A | 5/1989 | Hollingsworth | |
| 4,871,079 | A | 10/1989 | Doucette et al. | |
| D307,854 | S | 5/1990 | Doucette et al. | |
| 4,974,426 | A | 12/1990 | Gomez et al. | |
| 5,152,612 | A * | 10/1992 | Shoemaker | 383/6 |
| D333,592 | S | 3/1993 | Walker | |
| 5,474,481 | A * | 12/1995 | Ramsey | 441/131 |
| 5,564,288 | A | 10/1996 | Lewis | |
| 5,727,709 | A | 3/1998 | Nobile | |
| 5,797,528 | A | 8/1998 | McDuffie | |
| 5,938,336 | A | 8/1999 | King | |
| 6,014,833 | A | 1/2000 | Benavidez | |
| 6,016,933 | A | 1/2000 | Daily et al. | |
| 6,029,845 | A | 2/2000 | Mueller | |
| D426,415 | S | 6/2000 | Le Gette et al. | |
| 6,085,926 | A | 7/2000 | Weiss | |

(Continued)

OTHER PUBLICATIONS

Sportsstuff Inc., "Tropicooler," 16 Quart Inflatable Cooler, 2001
Sportsstuff Inc., www.sportsstuff.com, 3 pages, printed Apr. 15, 2002.

*Primary Examiner*—Anthony D. Stashick
*Assistant Examiner*—Harry A. Grosso

(57) ABSTRACT

An inflatable container having an inflatable chamber having a main storage compartment and a main storage compartment access opening, and further having a lower portion that includes at least one storage cavity having a storage cavity access opening. The inflatable container also includes an outer cover formed over the exterior of the inflatable chamber. The inflatable container also provides a storage bag that is formed such that when the inflatable chamber is deflated, the inflatable container may be contained within the storage bag.

22 Claims, 10 Drawing Sheets

U.S. PATENT DOCUMENTS 6,171,161 B1 * 1/2001 Peterson ..... 441/130
D440,121 S 4/2001 Peterson
D440,122 S 4/2001 Peterson
D443,182 S 6/2001 Peterson
6,253,950 B1 7/2001 Buck et al.

* cited by examiner

INFLATABLE FLOATING COOLER

CROSS-REFERENCE TO RELATED APPLICATIONS

This application claims the benefit of U.S. Provisional Application No. 60/384,967, filed Jun. 3, 2002, the disclosures of which are incorporated herein by reference.

BACKGROUND OF THE INVENTION

Field of Invention

This invention relates generally to the field of beverage holders. More specifically, the invention relates to inflatable beverage holders and floating coolers.

SUMMARY OF THE INVENTION

This invention includes an inflatable cooler, or container, having an inflatable chamber adapted to provide an interior chamber side wall and an interior chamber bottom wall configured to define a main storage compartment and a main storage compartment access opening, and further adapted to provide an exterior chamber side wall, a lower portion top wall, a lower portion side wall, and a lower portion bottom wall configured to define a lower portion, wherein the lower portion includes at least one storage cavity side wall and at least one storage cavity bottom wall configured to define at least one storage cavity having a storage cavity access opening.

The inflatable cooler also includes an outer cover formed over the exterior chamber side wall, the lower portion top wall, the lower portion side wall, and the lower portion bottom wall configured to define a lower portion, wherein the outer cover includes a storage bag enclosure opening.

The inflatable cooler further includes a storage bag adapted to provide a front side and a back side disposed between at least one side member, wherein the front side, the back side, and the at least one side member are configured to define a storage bag and a storage bag access opening, wherein the storage bag further includes a top section that is permanently or removably attached to the outer cover, such that the storage bag is accessible via the storage bag enclosure opening, and wherein the storage bag is formed such that when the inflatable chamber is deflated, the inflatable chamber may be contained within the storage bag.

BRIEF DESCRIPTION OF THE DRAWINGS

Exemplary embodiments of this inventions will be described in detail, with reference to the following figures, wherein like reference numerals refer to like parts throughout the several views, and wherein.

DETAILED DESCRIPTION

For simplicity and clarification, the operating principles, design factors, and layout of the inflatable floating cooler, or inflatable storage container, according to this invention are explained with reference to various exemplary embodiments of the inflatable floating cooler according to this invention. The basic explanation of the inflatable floating cooler is applicable for the understanding and design of the constituent components comprising the inflatable floating cooler of this invention.

Figure 1:
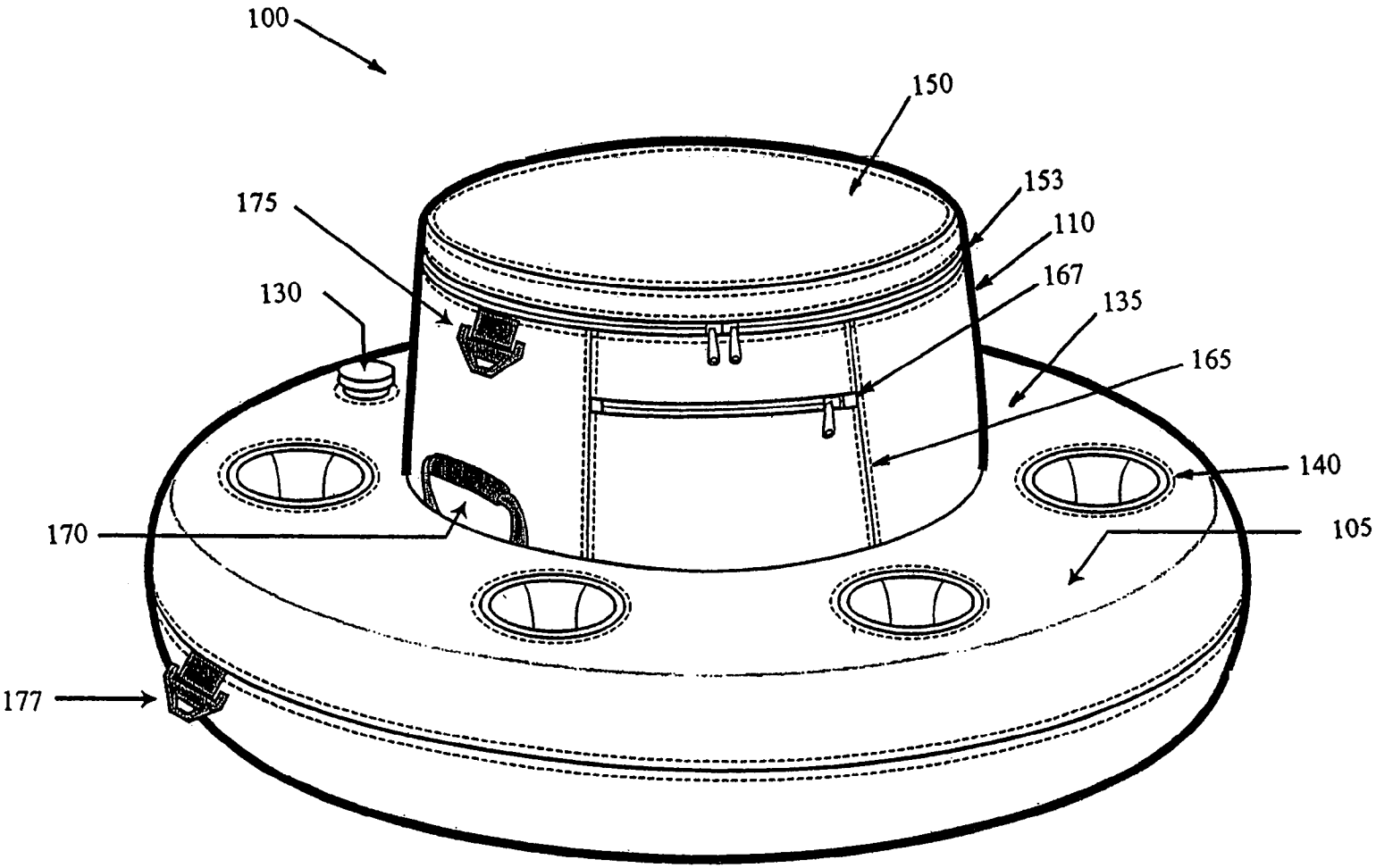
FIG. 1 is a top perspective view of a first exemplary embodiment of an inflatable floating cooler according to this invention.

FIG. 1 shows an inflatable floating cooler 100 according to this invention. As shown in FIG. 1, the inflatable floating cooler 100 includes at least some of an inflatable lower portion 105, an inflatable upper portion 110, an inflatable chamber 112, a valved opening 130, an outer cover material 135, at least one drain opening 137, at least one storage cavity 140, a main storage compartment 145, a primary insulator compartment 146, a primary insulator compartment insulator 147, a secondary insulator compartment 148, a secondary insulator compartment insulator 149, a lid 150, a lid insulator compartment 151, a lid insulator compartment insulator 152, a lid fastening means 153, a liner 160, a liner attachment 161, an interior storage compartment 163, an exterior storage compartment 165, an exterior storage compartment fastening means 167, a carry handle 170, at least one first attachment ring 175, at least one second attachment ring 177, at least one third attachment ring 179, a storage bag 180, a storage bag enclosure opening 185, a storage bag fastening means 183, and a storage bag enclosure fastening means 187.

Figure 2:
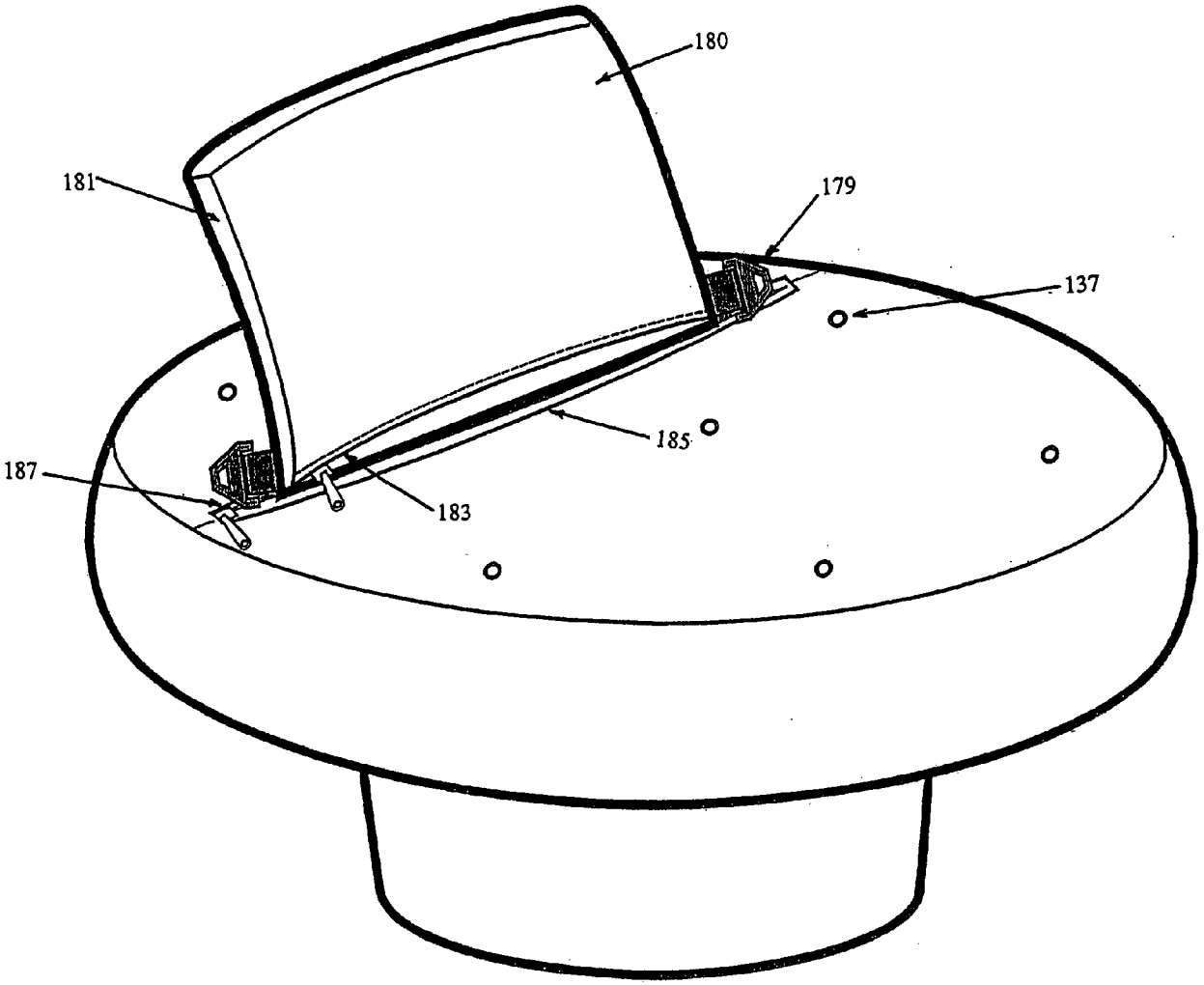
FIG. 2 is a bottom perspective view of the first exemplary embodiment of the inflatable floating cooler according to this invention.

FIGS. 1 and 2 show a top perspective view and a bottom perspective view, respectively, of an inflatable floating cooler 100 according to this invention. The inflatable floating cooler 100 is covered by an outer cover 135. In various exemplary embodiments, the outer cover 135 is made of a fabric or other material, such as nylon, spandex, neoprene, or the like. The outer cover 135 provides a protective outer structure for the inflatable cooler 100.

As shown in FIG. 2, the outer cover 135 may optionally include at least one drain opening 137. The at least one drain opening 137 allows any liquid, which is between the outer cover 135 and the inflatable chamber 112, to drain to the outside of the outer cover 135. The at least one drain opening 137 may comprise a grommet or other reinforced or non-reinforced opening in the outer cover 135. In various exemplary embodiments, the outer cover 135 may include a plurality of drain openings 137.

Figure 3:
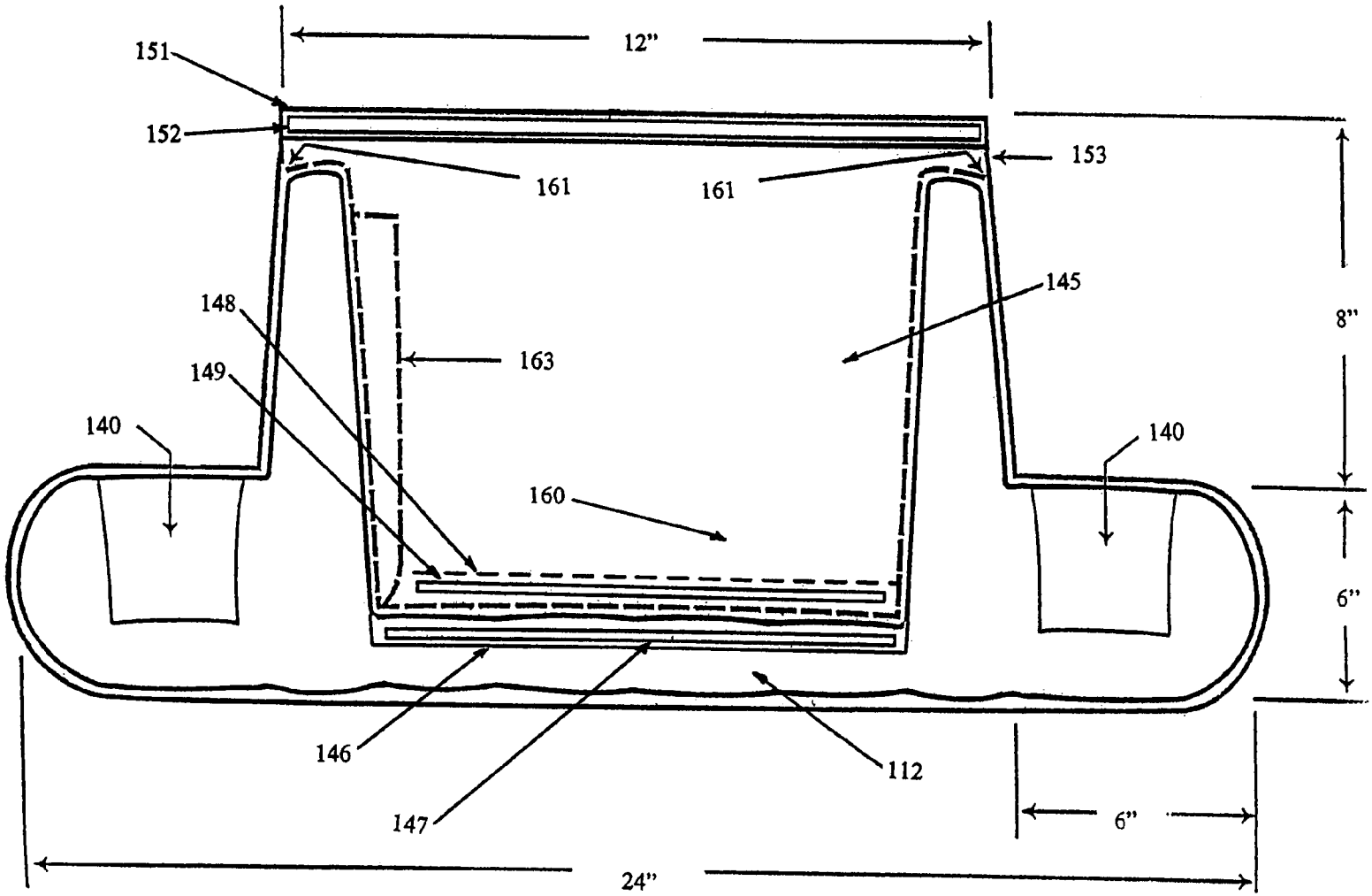
FIG. 3 is a cross sectional view of a first exemplary embodiment of the inflatable floating cooler according to this invention.

As shown in FIG. 3, the inflatable chamber 112 is at least partially enclosed within the outer cover material 135. In various exemplary embodiments, the inflatable chamber 112 is made of a non-air permeable material, such as, for example, plastic or rubber. The inflatable chamber 112 may be constructed so as to provide the basic shape of the inflatable floating cooler 100 to the outer cover material 135, when inflated. The inflatable chamber 112 may be constructed of a single piece of non-air permeable material or multiple pieces of air permeable material, sewn or otherwise joined to form the basic shape of the inflatable cooler 100. The inflatable chamber 112 includes a valved opening 130 for inflating and deflating the inflatable chamber 112.

The inflatable lower portion 105 includes a plurality of storage cavities 140 arranged on a top side of the inflatable lower portion 105. Each storage cavity 140 is substantially adapted for accepting a cylindrical container (not shown) therein. It should be appreciated that although each storage cavity 140, as shown and described herein, is shown to be a generally cylindrical cavity, in various exemplary embodiments, each storage cavity 140 may be of a different shape. Furthermore, within the plurality of storage cavities 140, storage cavities of various shapes, sizes, and depths, may be present.

As shown in FIG. 1, the inflatable upper portion 110 is positioned substantially centrally of the inflatable lower portion 105. The size, shape, and placement of the inflatable upper portion 110 allows the inflatable floating cooler 100 to remain relatively stable when floating on the surface of a liquid.

A main storage compartment 145 is created within the inflatable floating cooler 100. In various exemplary embodiments, a primary insulator compartment 146 is created at a bottom of the main storage compartment 145. The primary insulator compartment 146 provides a space in which a primary insulator compartment insulator 147 may be placed. The primary insulator compartment insulator 147 may be a material, such as, for example, foam, which will provide improved insulating qualities to the main storage compartment 145.

In various exemplary embodiments, a liner 160 is removably positioned within the main storage compartment 145. The liner may be constructed of a waterproof material, such that the liner 160 is capable of holding a fluid. In various exemplary embodiments, the liner 160 includes a secondary insulator compartment 148 formed at a bottom of the liner 160. The secondary insulator compartment 148 provides a space in which a secondary insulator compartment insulator 149 may be placed. The secondary insulator compartment insulator 149 may be a material, such as, for example, foam, which will provide improved insulating qualities to the liner 160.

It should be appreciated that the primary insulator compartment insulator 147 and/or the secondary insulator compartment insulator 149 may be replaced with any known or later developed element for providing additional heating or cooling to the inflatable floating cooler 100. For example, a chemical heating pack may be placed in the primary insulator compartment 146 or the secondary insulator compartment 148 to help maintain a desired temperature in the main storage compartment 145. Conversely, an ice pack may be placed in the primary insulator compartment 146 or the secondary insulator compartment 148 to help maintain a desired lower temperature in the main storage compartment 145.

In various exemplary embodiments, the liner 160 is removably positioned within the main storage compartment 145 by means of a liner attachment 161. The liner attachment 161 may comprise a hook and loop fastener, such as Velcro. It should be appreciated that, in various exemplary embodiments the liner attachment 161 may be secured within the main storage compartment 145 by other attachment means or releasable fasteners, such as, for example, male/female snap-release buckles, a ziplock fastening device, a zipper, buttons, snaps, or other fastening, closure, or attachment means known by those skilled in the art. Alternatively, the liner 160 may be removably fitted within the main storage compartment 145 without being attached within the main storage compartment 145.

In various exemplary embodiments, the liner 160 includes an interior storage compartment 163 constructed so as to allow items to be separated within the main storage compartment 145.

The lid 150 is constructed such that it is capable of covering the main storage compartment 145. The lid 150 is hingedly connected to the inflatable upper portion 110 by a lid hinge (not shown). The lid hinge may be constructed of fabric, plastic, or other suitable material. In various exemplary embodiments, the lid 150 includes a lid fastening means 153. The lid fastening means 153 allows the lid 150 to be maintained in a closed position atop the inflatable upper portion 110. In various exemplary embodiments, the lid fastening means 153 comprises releasable fasteners such as male/female snap-release buckles, Velcro or other hook-and-loop fasteners, a ziplock fastening device, a zipper, buttons, snaps, or other fastening or closure means known by those skilled in the art.

In various exemplary embodiments, the lid 150 is comprised of a top lid section and a bottom lid section. The top lid section and the bottom lid section define the lid insulator compartment 151 that can be filled with a lid insulator compartment insulator 152. The lid insulator compartment insulator 152 may be a material, such as, for example, foam, which will provide improved insulating qualities and shape to the lid 150, even when the inflatable floating cooler 100 is deflated.

It should be appreciated that the lid insulator compartment insulator 152 may be replaced with any known or later developed element for providing additional heating or cooling to the inflatable floating cooler 100. For example, a chemical heating pack may be placed in the lid insulator compartment insulator 152, as a coolant, to help maintain a desired temperature in the main storage compartment 145. Conversely, an ice pack may be placed in the lid insulator compartment insulator 152, as a coolant, to help maintain a desired lower temperature in the main storage compartment 145.

Optionally, the inflatable floating cooler 100 includes an exterior storage compartment 165. The exterior storage compartment 165 comprises a pocket formed on the exterior of the inflatable upper portion 110. In various exemplary embodiments, the exterior storage compartment 165 is made of the same material as the outer cover material 135. Alternatively, the exterior storage compartment 165 may be made of a different material, such as, for example, a flexible webbing. The exterior storage compartment 165 may be constructed to include small pleats, thereby allowing the exterior storage compartment to expand outwardly from the inflatable upper portion 110.

In various exemplary embodiments, the exterior storage compartment 164 includes an exterior storage compartment fastening means 167, which allows the exterior storage compartment 165 to be closed. In various exemplary embodiments, the exterior storage compartment fastening means 167 comprises releasable fasteners such as male/female snap-release buckles, Velcro or other hook-and-loop fasteners, a ziplock fastening device, a zipper, buttons, snaps, or other fastening or closure means known by those skilled in the art.

The inflatable floating cooler 100 may include at least one first attachment ring 175 fixedly attached to the inflatable upper portion 110. Similarly, at least one second attachment right 177 may also be included, which is fixedly attached to the inflatable lower portion 105. In various exemplary embodiments, at least one carry handle 170 is also included. The carry handle 170 is fixedly attached to the inflatable lower portion 105, the inflatable upper portion 110, or a juncture where the upper portion and the lower portion meet.

Figure 8:
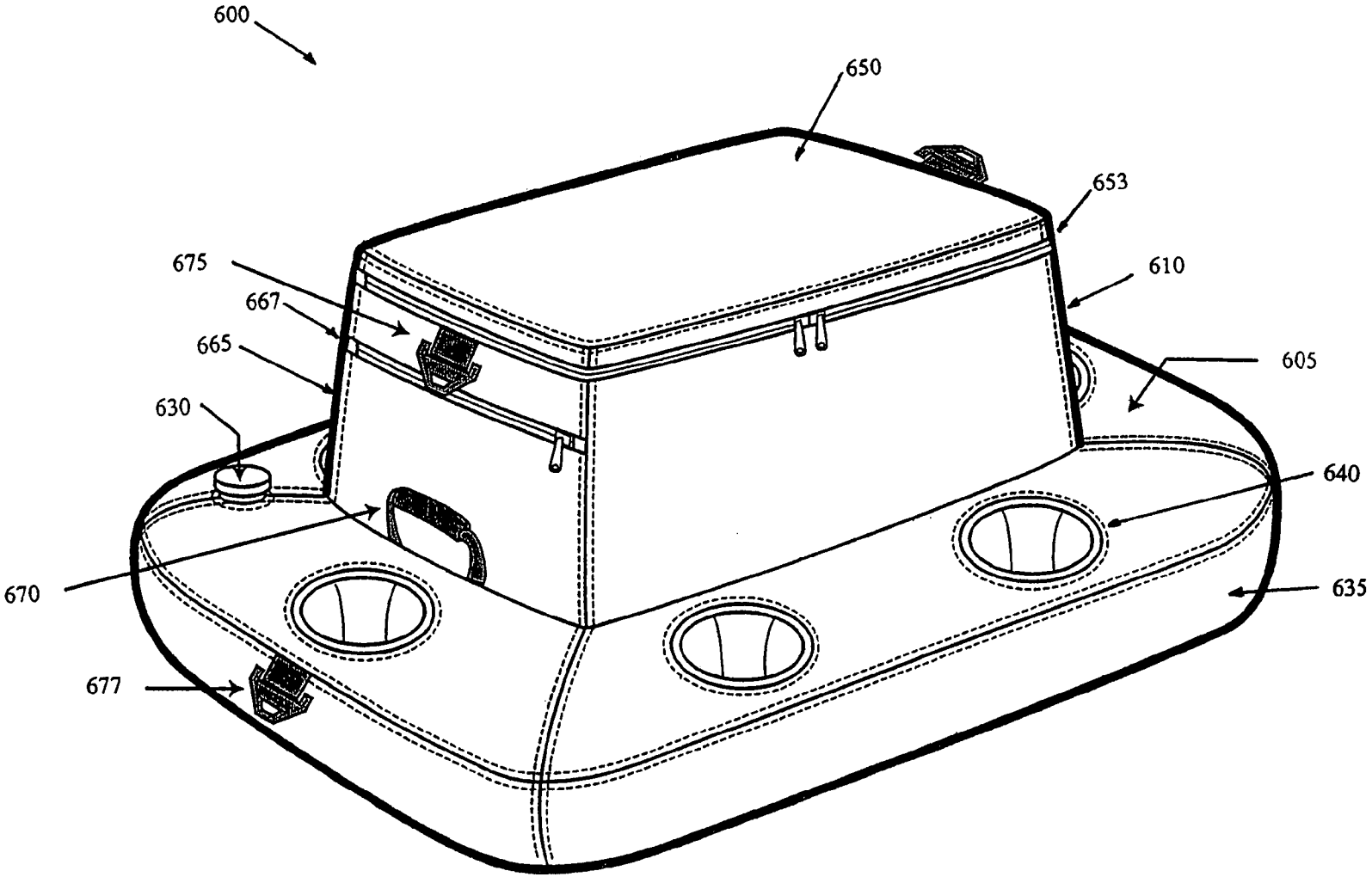
FIG. 8 shows a top perspective view of a another exemplary embodiment of an inflatable floating cooler according to this invention.
Figure 9:
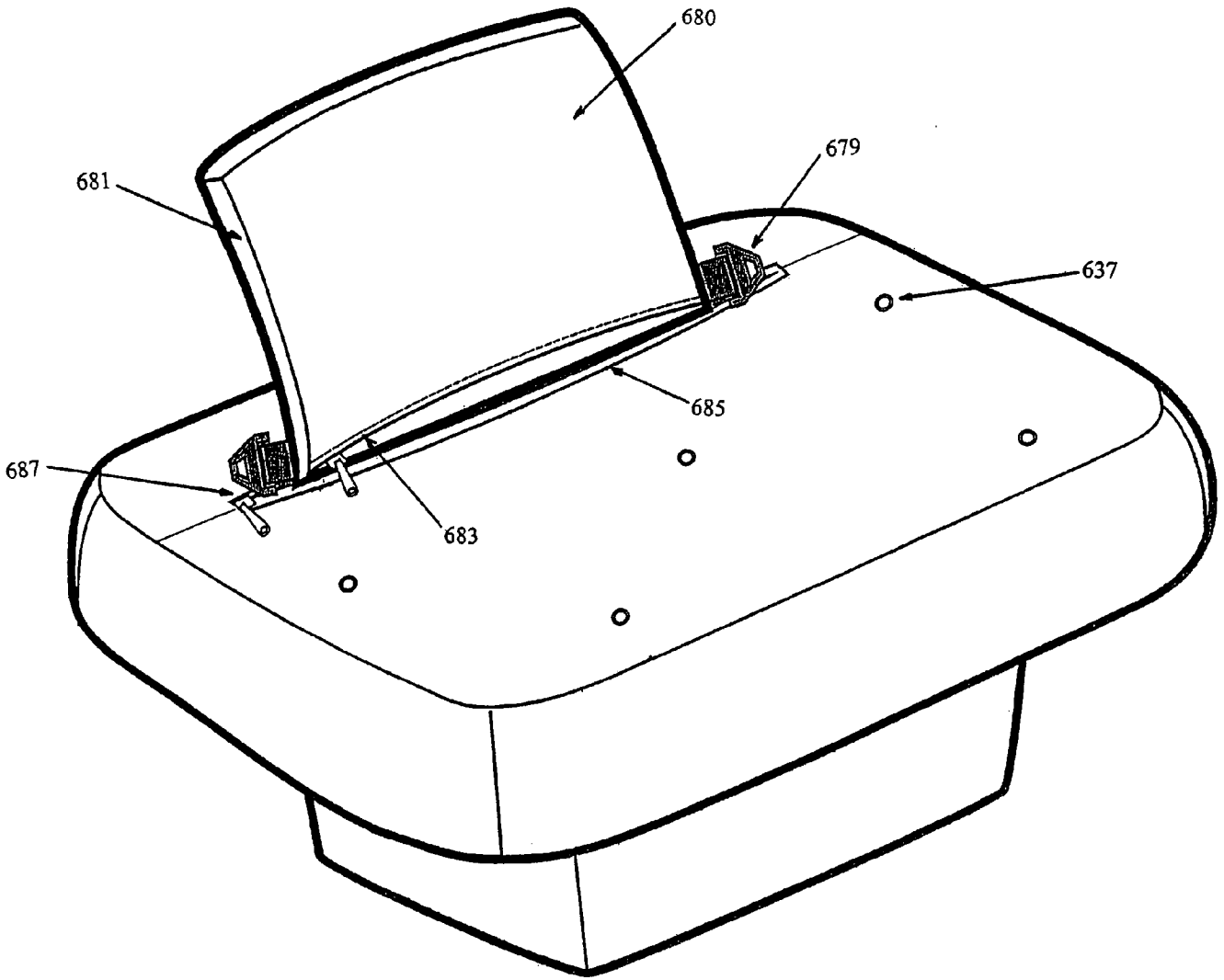
FIG. 9 shows a bottom perspective view of the exemplary embodiment of the inflatable floating cooler of FIG. 8.

In various exemplary embodiments, the exterior dimensions of the inflatable floating cooler 100 are as shown in FIG. 3. However, it should be appreciated that these dimensions are included merely for the purpose of illustrating an exemplary embodiment of the inflatable floating cooler 100, and are not intended to limit the size or shape of the inflatable floating cooler 100 in any way. For example, the inflatable floating cooler 100 may embody a generally circular shape, as shown in FIGS. 1–7, a generally rectangular shape, as shown in FIGS. 8–9, or any other desirable shape. The overall shape and dimension of the inflatable floating cooler of this invention is a design choice.

As shown in FIG. 2, the inflatable floating cooler 100 also includes a storage bag 180. In various exemplary embodiments, the storage bag 180 is constructed of the same material as the outer cover material 135. Alternatively, the storage bag 180 may be made of a different material, such as, for example, a flexible webbing.

The storage bag 180 includes a top section that is permanently or removably attached to an inner side of the outer cover material 135. In various exemplary embodiments, the top section of the storage bag 180 is permanently or removably attached to the inner side of the outer cover material 135.

The storage bag 180 is constructed such that when the inflatable chamber 112 is deflated, the inflatable cooler 100 can be contained within the storage bag 180. In various exemplary embodiments, the storage bag 180 includes at least one side member 181 disposed between a front side of the storage bag 180 and a back side of the storage bag 180. In various exemplary embodiments, the side member 181 is comprised of a mesh fabric panel, such that sand, dirt, particles, or water that has accumulated within the storage bag 180 may escape from the storage bag 180.

The storage bag 180 includes a storage bag fastening means 183, whereby the storage bag 180 may be closed to fully enclose a deflated inflatable floating cooler 100. In various exemplary embodiments, the storage bag 180 includes a storage bag enclosure flap (not shown). In various exemplary embodiments, the storage bag fastening means 183 comprises releasable fasteners such as male/female snap-release buckles, Velcro or other hook-and-loop fasteners, a ziplock fastening device, a zipper, buttons, snaps, or other fastening or closure means known by those skilled in the art.

A storage bag enclosure opening 185 is included in the portion of the outer cover material 135 that covers a bottom section of the inflatable floating cooler 100. The storage bag enclosure opening 185 allows the storage bag 180 to be stowed between the inner side of the outer cover material 135 and a bottom side of the inflatable chamber 112.

In various exemplary embodiments, the storage bag enclosure opening 185 includes a storage bag enclosure fastening means 187. The storage bag enclosure fastening means 187 allows the storage bag enclosure opening 185 to be maintained in a closed position and contain the storage bag 180. In various exemplary embodiments, the storage bag enclosure fastening means 187 comprises releasable fasteners such as male/female snap-release buckles, Velcro or other hook-and-loop fasteners, a ziplock fastening device, a zipper, buttons, snaps, or other fastening or closure means known by those skilled in the art.

In various exemplary embodiments, the storage bag 180 includes at least one third attachment ring 179, which allows the storage bag 180 to be removably connected to, for example, a shoulder strap (not shown).

It should be appreciated that although the storage bag 180 and the storage bag enclosure opening 185 have been shown and described as being generally located and/or attached at a bottom of the inflatable floating cooler 100, in various exemplary embodiments, the storage bag 180 and the storage bag enclosure opening 185 may be located and/or attached to a different portion of the inflatable floating cooler 100. For example, the storage bag 180 and the storage bag enclosure opening 185 may be located and/or attached in the area of the inflatable lower portion 105, the inflatable upper portion 110, the main storage compartment 145, or the lid 150.

Additionally, in various exemplary embodiments, the storage bag 180 may be included without the storage bag enclosure opening 185.

Figure 4:
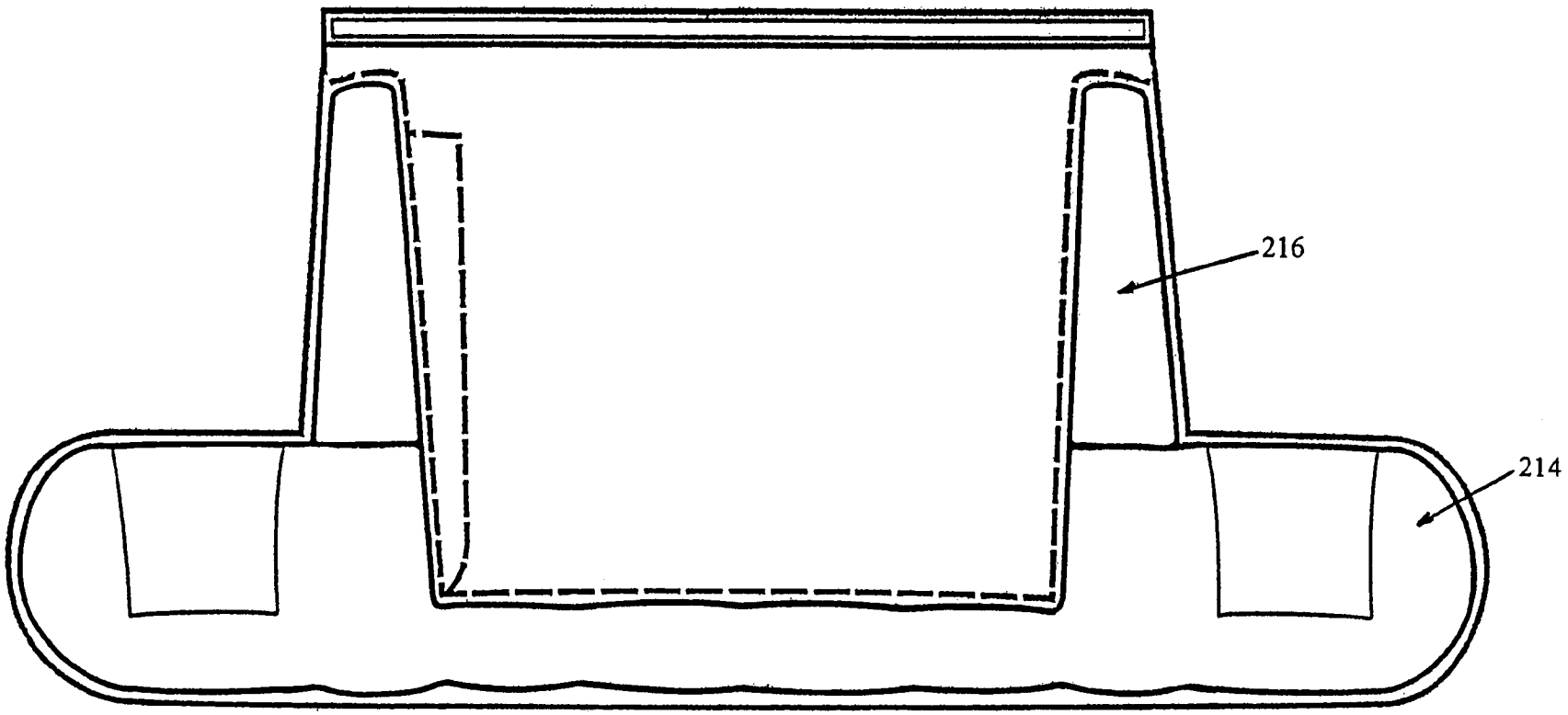
FIG. 4 shows a cross sectional view of a second exemplary embodiment of the inflatable floating cooler according to this invention.

FIG. 4 shows a second exemplary embodiment of the inflatable chamber 112, shown in FIG. 3. As shown in FIG. 4, the inflatable chamber 112 comprises a lower inflatable chamber 214 and an upper inflatable chamber 216. The lower inflatable chamber 214 and the upper inflatable chamber 216 operate similarly to the inflatable chamber 112 discussed above with respect to FIG. 1. However, the inclusion of the lower inflatable chamber 214 and the upper inflatable chamber 216 may provide improved structural support and stability to the inflatable floating cooler 100.

Figure 10:
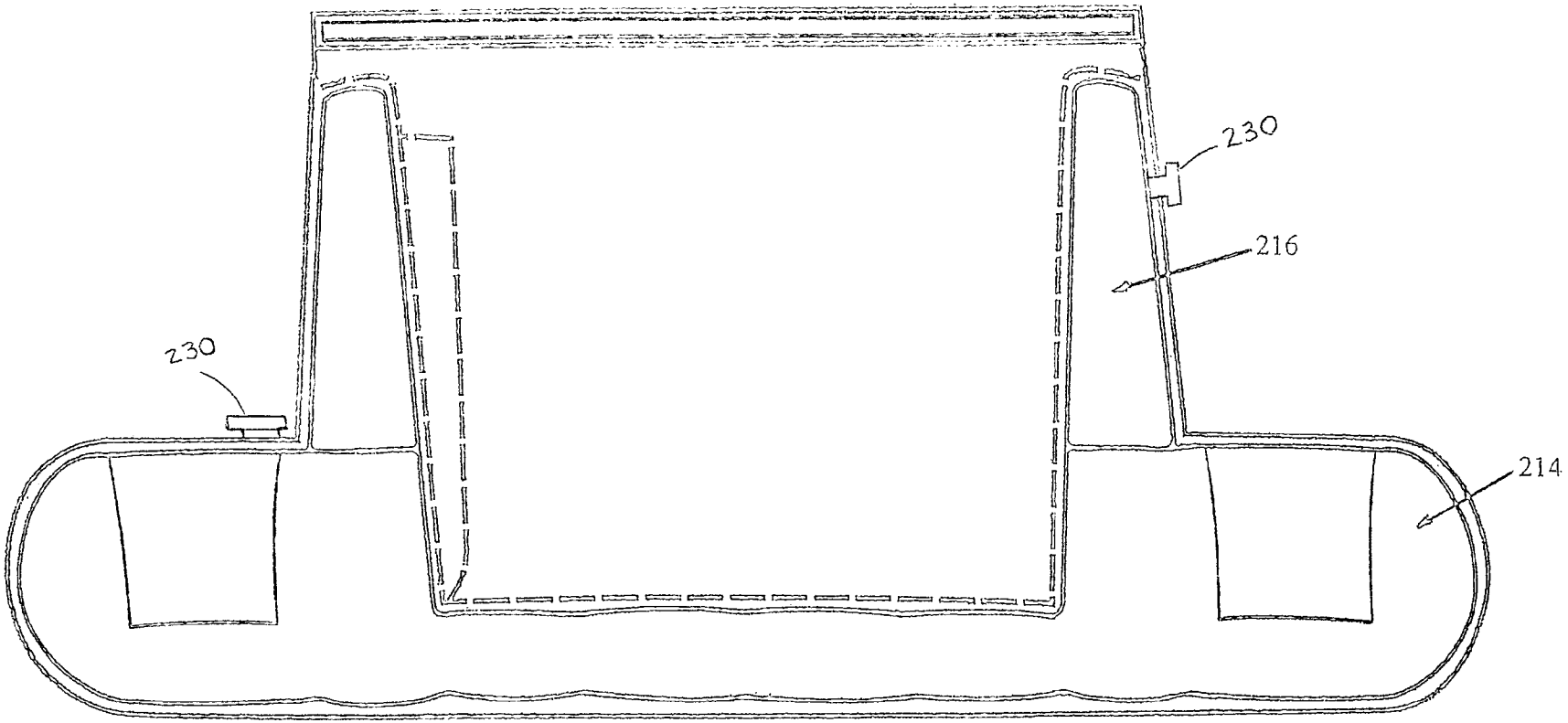
FIG. 10 is a cross-sectional view of another embodiment of an inflatable floating cooler including multiple valves.

In various exemplary embodiments, the lower inflatable chamber 214 and the upper inflatable chamber 216 each have a separate valved opening 230 (shown in FIG. 10) such that each chamber can be inflated or deflated independently. Alternatively, the lower inflatable chamber 214 and the upper inflatable chamber 216 can be in communicating relationship such that at least one common valved opening (not shown) may be used to inflate or deflate both chambers. In these exemplary embodiments, communicating areas, such as, for example, holes along portions of the inflatable chambers that are common to both chambers may be used to allow gas from one chamber to be communicated to another chamber.

Figure 5:
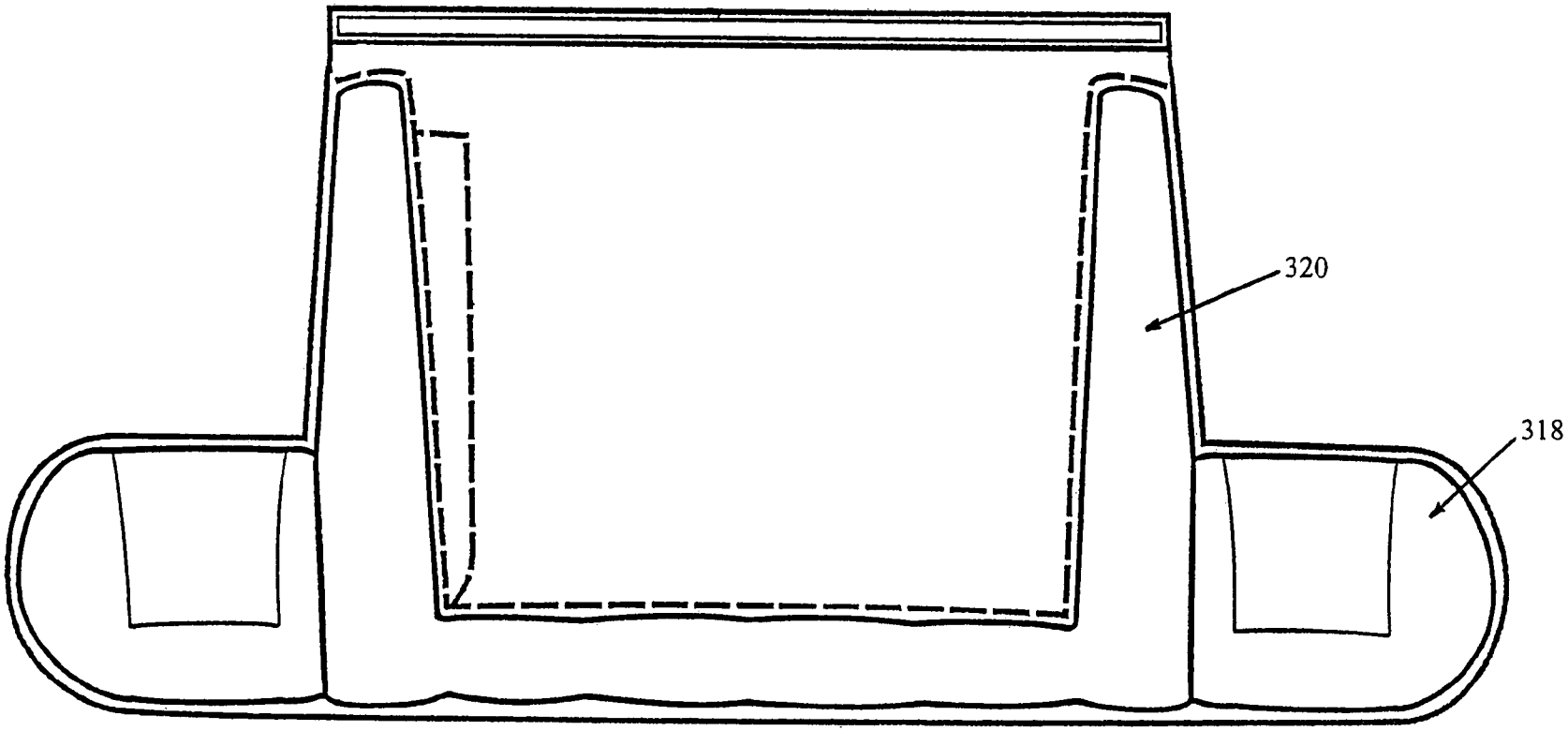
FIG. 5 shows a cross sectional view of a third exemplary embodiment of the inflatable floating cooler according to this invention.

FIG. 5 shows a third exemplary embodiment of the inflatable chamber 112. As shown in FIG. 5, the inflatable chamber 112 is comprised of an outer inflatable chamber 318 and an inner inflatable chamber 320. The outer inflatable chamber 318 and the inner inflatable chamber 320 operate similarly to the lower inflatable chamber 214 and the upper inflatable chamber 216 discussed above with respect to FIG. 4. However, the arrangement of the outer inflatable chamber 318 and the inner inflatable chamber 320 may provide improved structural support and stability to the inflatable floating cooler 100.

Figure 6:
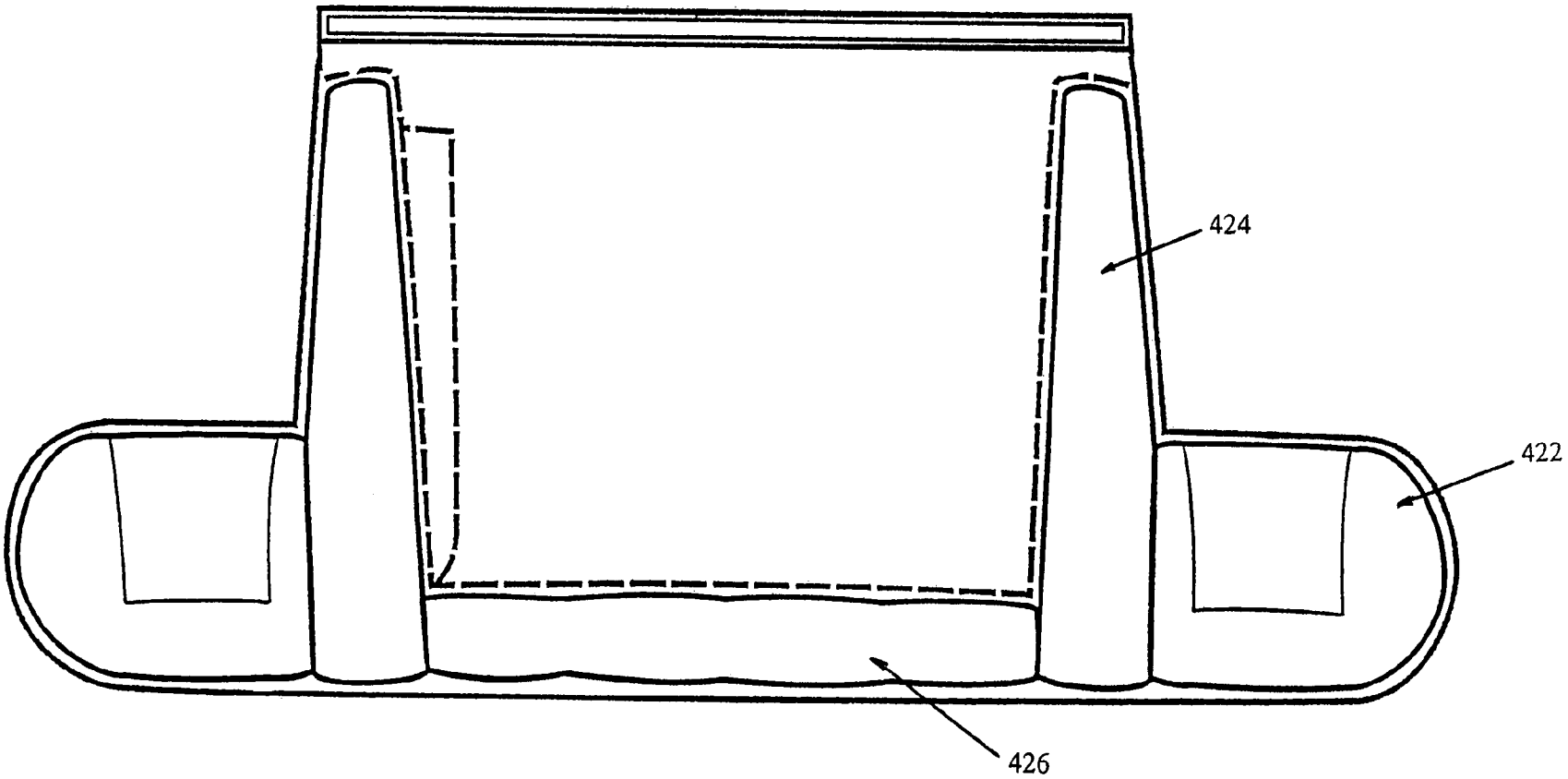
FIG. 6 shows a cross sectional view of a fourth exemplary embodiment of the inflatable floating cooler according to this invention.

FIG. 6 shows a fourth exemplary embodiment of the inflatable chamber 112. As shown in FIG. 6, the inflatable chamber 112 comprises an outer inflatable chamber 422, an intermediate inflatable chamber 424, and an inner inflatable chamber 426. The outer inflatable chamber 422, the intermediate inflatable chamber 424, and the inner inflatable chamber 426 operate similarly to the lower inflatable chamber 214 and the upper inflatable chamber 216 discussed above with respect to FIG. 4, and the outer inflatable chamber 318 and the inner inflatable chamber 320 discussed above with respect to FIG. 5. However, the inclusion of the outer inflatable chamber 422, the intermediate inflatable chamber 424, and the inner inflatable chamber 426 may provide improved structural support and stability to the inflatable floating cooler 100.

Figure 7:
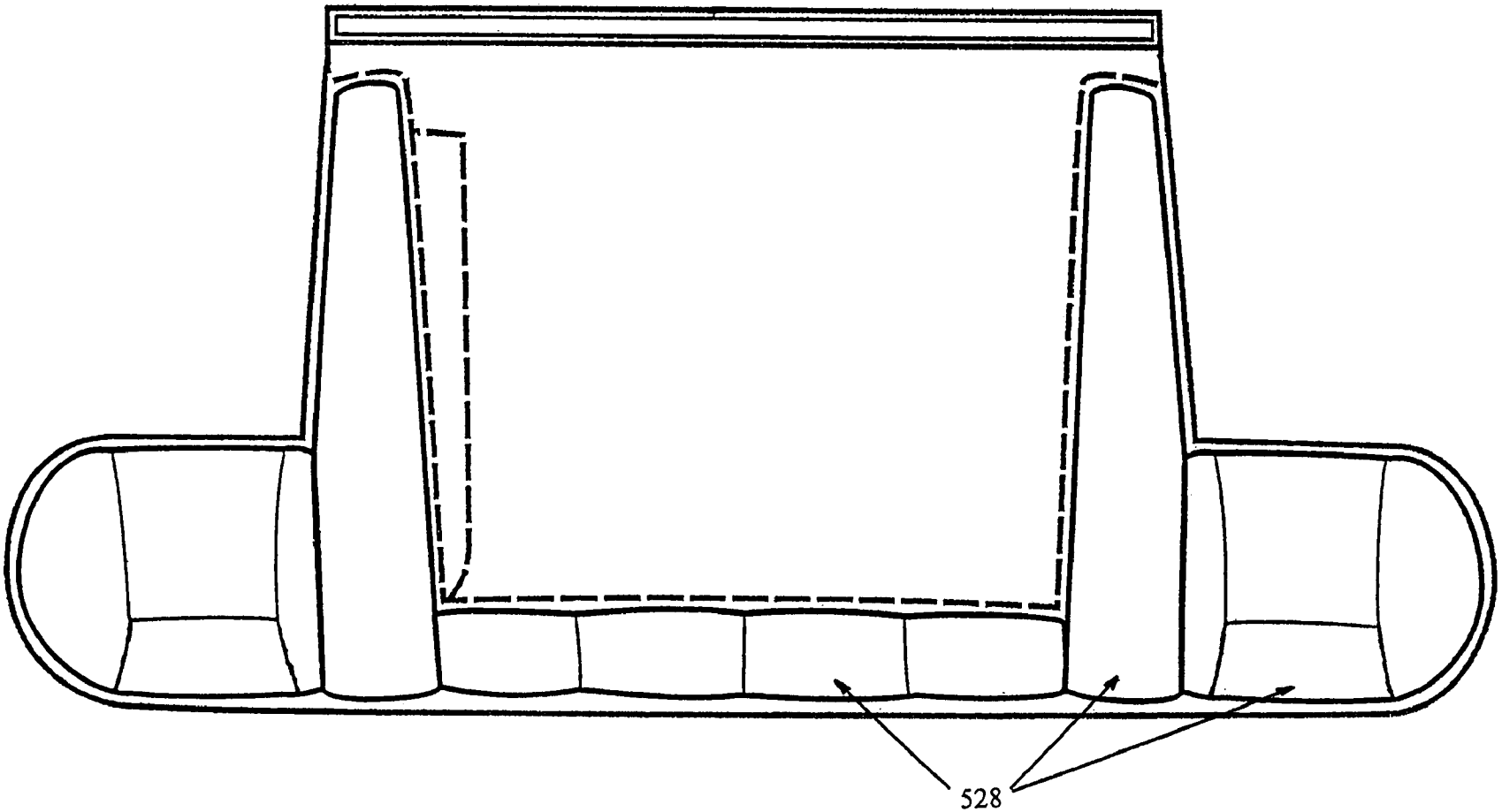
FIG. 7 shows a cross sectional view of a fifth exemplary embodiment of the inflatable floating cooler according to this invention.

FIG. 7 shows a fifth exemplary embodiment of the inflatable chamber 112. As shown in FIG. 7, the inflatable chamber 112 comprises a plurality of inflatable chambers 528. Each inflatable chamber 528 operates similarly to the inflatable chambers discussed above. For example, each inflatable chamber 528 may have an individual valved opening (not shown), or a combination of specific inflatable chambers 528, may share a common valved opening (not shown). The inclusion of a plurality of inflatable chambers 528 may provide improved structural support and stability to the inflatable floating cooler 100.

It should be appreciated that, although the primary insulator compartment 146, the primary insulator compartment insulator 147, the secondary insulator compartment 148, or the secondary insulator compartment insulator 149 were not shown in FIGS. 4–7, one or more of these elements may be included in the exemplary embodiments shown and described in FIGS. 4–7.

FIGS. 8 and 9 show a top perspective view and a bottom perspective view, respectively, of another exemplary embodiment of an inflatable floating cooler 600, according to this invention. As shown in FIG. 8, the inflatable floating cooler 600 includes at least some of an inflatable lower portion 605, an inflatable upper portion 610, an inflatable chamber 612, an valved opening 630, an outer cover material 635, at least one drain opening 637, at least one storage cavity 640, a main storage compartment 645, a primary insulator compartment 646, a primary insulator compartment insulator 647, a secondary insulator compartment 648, a secondary insulator compartment insulator 649, a lid 650, a lid insulator compartment 651, a lid insulator compartment insulator 652, a lid fastening means 653, a liner 660, a liner attachment 661, an interior storage compartment 663, an exterior storage compartment 665, an exterior storage compartment fastening means 667, a carry handle 670, at least one first attachment ring 675, at least one second attachment ring 677, at leas one third attachment ring 679, a storage bag 680, a storage bag enclosure opening 685, a storage bag fastening means 683, and a storage bag enclosure fastening means 687.

These elements operate similarly to the elements discussed above with respect to FIGS. 1–7. However, the overall shape of the inflatable floating cooler 600 is rectangular, while the overall shape of the inflatable floating cooler 100 is circular.

It should be understood that the inflatable chamber 612 may comprise a single inflatable chamber or multiple inflatable chambers, as described above, with reference to FIGS. 3–7.

It should be appreciated that the materials selected to form the various elements of the inflatable floating cooler may be selected based on their ability to act as insulators or insulating materials, thereby increasing the inflatable floating cooler's ability to insulate items placed within the inflatable floating cooler's various storage cavities and compartments.

While this invention has been described in conjunction with the exemplary embodiments outlined above, it is evident that many alternatives, modifications, and variations will be apparent to those skilled in the art. Accordingly, the exemplary embodiments of the invention, as set forth above, are intended to be illustrative, not limiting. Various changes, modifications, and/or adaptations may be made without departing from the spirit and scope of this invention.

What is claimed is:

1. An apparatus, comprising:

at least one membrane defining an inflatable chamber, the at least one membrane having a side wall and a bottom wall defining a storage compartment and defining an opening in communication with the storage compartment, the at least one membrane having an upper portion and a lower portion, the lower portion defining an outer perimeter larger than an outer perimeter defined by the upper portion, the storage compartment being at least partially defined within the upper portion, the lower portion of the at least one membrane being disposed between the upper portion of the at least one membrane and the bottom wall, the apparatus configured to float in a liquid when the inflatable chamber is in an inflated configuration such that the opening, the bottom wall and the surface of the liquid are substantially parallel, an insulator membrane, the insulator membrane and at least one of the side wall or the bottom wall defining an insulator compartment; and an insulator member configured to be removably disposed within the insulator compartment.

2. The apparatus of claim 1, wherein the at least one membrane includes a lower side wall and a lower bottom wall that define a cavity.

3. The apparatus of claim 1, wherein the inflatable chamber is a first inflatable chamber, and the at least one membrane further defines a second inflatable chamber.

4. The apparatus of claim 1, wherein the insulator membrane is a first insulator membrane, the insulator compartment being a first insulator compartment, the insulator member being a first insulator member, the apparatus further comprising:

a second insulator membrane, the second insulator membrane and at least one of the side wall or the bottom wall defining a second insulator compartment; and a second insulator member configured to be removably disposed within the second insulator compartment.

5. The apparatus of claim 1, further comprising:

a cover at least partially enclosing the at least one membrane.

6. The apparatus of claim 1, wherein the at least one membrane defines an opening in communication with the storage compartment, the at least one membrane includes a first membrane, the apparatus further comprising:

a lid configured to be coupled to the first membrane in a first configuration in which the opening is substantially covered by the lid and a second configuration in which the opening is at least partially uncovered.

7. The apparatus of claim 1, wherein the inflatable chamber is a first inflatable chamber, the at least one membrane further defining a second inflatable chamber, the apparatus further comprising:

a first valve coupled to the at least one membrane such that the first inflatable chamber is in communication with the first valve; and a second valve coupled to the at least one membrane such that the second inflatable chamber is in communication with the second valve.

8. The apparatus of claim 1, wherein the at least one membrane includes a first membrane, the apparatus further comprising:

a storage bag coupled to the first membrane, the storage bag configured to receive the at least one membrane when the inflatable chamber is in a deflated configuration.

9. The apparatus of claim 1, wherein the at least one membrane includes a first membrane, the apparatus further comprising:

a lid configured to be coupled to the first membrane such that the lid substantially covers the opening, the lid defining a lid insulator compartment; and a lid insulator member configured to be removably disposed within the lid insulator compartment.

10. The apparatus of claim 1, wherein the insulator member includes at least one of a solid or a liquid.

11. An apparatus, comprising:

at least one membrane defining at least one inflatable chamber the at least one membrane including a first membrane, the at least one membrane having a side wall and a bottom wall, the side wall and the bottom wall collectively defining a storage compartment and an opening in communication with the storage compartment, a center of the opening being substantially at a center of the apparatus;

an insulator membrane, the insulator membrane and at least one of the side wall or the bottom wall defining an insulator compartment; and an insulator member configured to be removably disposed within the insulator compartment, the storage compartment configured to removably receive items through the opening when the insulator member is disposed within the insulator compartment; and a lid configured to be coupled to the first membrane in a first configuration in which the opening is substantially covered by the lid and a second configuration in which the opening is at least partially uncovered.

12. The apparatus of claims 11, further comprising:

a cover at least partially enclosing the at least one membrane.

13. The apparatus of claim 11, wherein the at least one membrane is configured to float on a surface of a liquid when the at least one inflatable chamber is in an inflated configuration such that the opening is substantially parallel with the surface of the liquid.

14. The apparatus of claim 11, wherein the at least one membrane includes a first membrane, the apparatus further comprising:

a storage bag coupled to the first membrane, the storage bag configured to receive the at least one membrane when the at least one inflatable chamber is in a deflated configuration.

15. The apparatus of claim 11, wherein the at least one inflatable chamber is a plurality of inflatable chambers, the apparatus further comprising:

a plurality of valves coupled to the at least one membrane such that each inflatable chamber from the plurality of inflatable chambers is in communication with a different valve from the plurality of valves.

16. An apparatus, comprising:

at least one membrane defining at least one inflatable chamber, the at least one membrane having a side wall and a bottom wall, the side wall and the bottom wall defining a storage compartment and an opening in communication with the storage compartment, the opening being disposed substantially at a center of the apparatus;

a cover at least partially enclosing an outer surface of the at least one membrane, the at least one membrane, the cover, and the at least one inflatable chamber collectively configured to float in a liquid when the at least one inflatable chamber is in an inflated configuration such that the opening and the bottom wall are substantially parallel with a surface of the liquid;

an insulator membrane, the insulator membrane and at least one of the bottom wall or the side wall defining an insulator compartment; and an insulator member configured to be removably disposed within the insulator compartment, the insulator member including at least one of a solid or a liquid.

17. The apparatus of claim 16, wherein the at least one membrane has a lower side wall and a lower bottom wall that define a cavity and an opening in communication with the cavity.

18. The apparatus of claim 16, wherein the at least one membrane includes a first membrane, the apparatus further comprising:

a storage bag coupled to the first membrane, the storage bag configured to receive the at least one membrane when the at least one inflatable chamber is in a deflated configuration.

19. The apparatus of claim 16, wherein the at least one membrane includes a first membrane, the apparatus further comprising:

a lid configured to be coupled to first membrane in a first configuration in which the lid substantially covers the opening and a second configuration in which the opening is at least partially uncovered.

20. The apparatus of claim 16, wherein the at least one membrane includes a first membrane, the apparatus further comprising:

a lid configured to be coupled to the first membrane, the lid defining a lid insulator compartment; and a lid insulator member configured to be removably disposed within the lid insulator compartment.

21. The apparatus of claim 16, wherein the at least one inflatable chamber includes a first inflatable chamber and a second inflatable chamber.

22. The apparatus of claim 16, wherein the at least one inflatable chamber includes a first inflatable chamber and a second inflatable chamber, the apparatus further comprising:

a first valve coupled to the at least one membrane such that the first inflatable chamber is in communication with the first valve; and a second valve coupled to the at least one membrane such that the second inflatable chamber is in communication with the second valve.

* * * * *